United States Patent [19]

Wilder et al.

[11] Patent Number: 4,956,896

[45] Date of Patent: Sep. 18, 1990

[54] METHOD AND APPARATUS FOR FORMING NONWOVEN FIBER WEBS

[75] Inventors: Michael L. Wilder, Victor; Michael A. Ruffalo, Newark; George R. Lilly, Palmyra; William M. Hardy, Victor, all of N.Y.

[73] Assignee: Phoenix Associates, Victor, N.Y.

[21] Appl. No.: 347,392

[22] Filed: May 3, 1989

[51] Int. Cl.[5] ..... D01G 25/00; D04H 1/00

[52] U.S. Cl. ..... 19/305; 19/304; 19/296

[58] Field of Search ..... 19/296–302, 19/305

[56] References Cited

U.S. PATENT DOCUMENTS

| | | | |
|---|---|---|---|
| 2,653,416 | 9/1953 | Slayter | 19/305 |
| 3,158,668 | 11/1964 | Johnson | 19/305 |
| 3,252,186 | 5/1966 | Oja | 19/305 |
| 3,740,797 | 6/1973 | Farrington | 19/302 |
| 3,792,943 | 2/1974 | Helgesson | 19/300 |
| 4,106,163 | 8/1978 | Desuerchére | 19/296 |
| 4,355,438 | 10/1982 | Reeves, Jr. et al. | 19/305 |
| 4,534,086 | 8/1985 | Fehrer | 19/302 |
| 4,637,104 | 1/1987 | Mente | 19/296 |

*Primary Examiner*—Werner H. Schroeder
*Assistant Examiner*—Michael A. Neas
*Attorney, Agent, or Firm*—Shlesinger, Fitzsimmons & Shlesinger

[57] ABSTRACT

The web or mat producing unit including a fiber opening and doffing mechanism mounted on a vertically adjustable platform to direct fibers randomly downwardly through an opening in the platform and onto the horizontal upper run of an endless screen, which travels in one direction over a vacuum or suction opening positioned beneath and parallel to the upper run. Two, spaced side curtains or panels, which are suspended from the underside of the platform, guide fibers into a predetermined space located between opposite sides of the upper run of the screen, thereby to form the fibers into a shingle-free nonwoven mat which may, if desired, be fed successively onto the upper run of the screen in the next successive unit in a series thereof. The width and configuration of the mat can be changed by adjusting the panels toward and away from each other, and by placing a removable template or baffle over the suction opening.

13 Claims, 4 Drawing Sheets

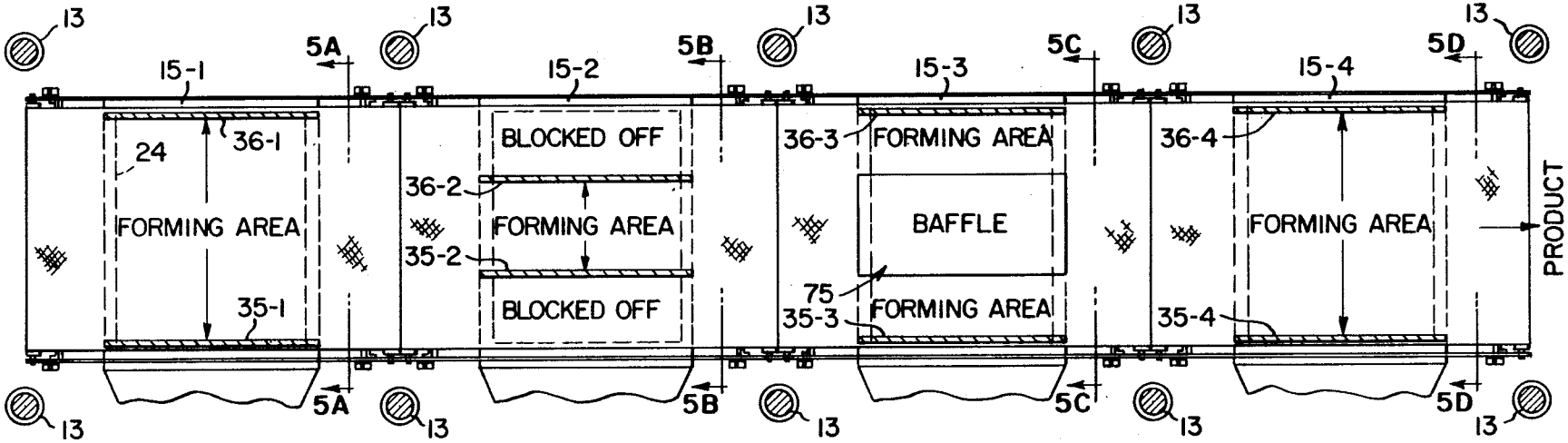
FIG. 4
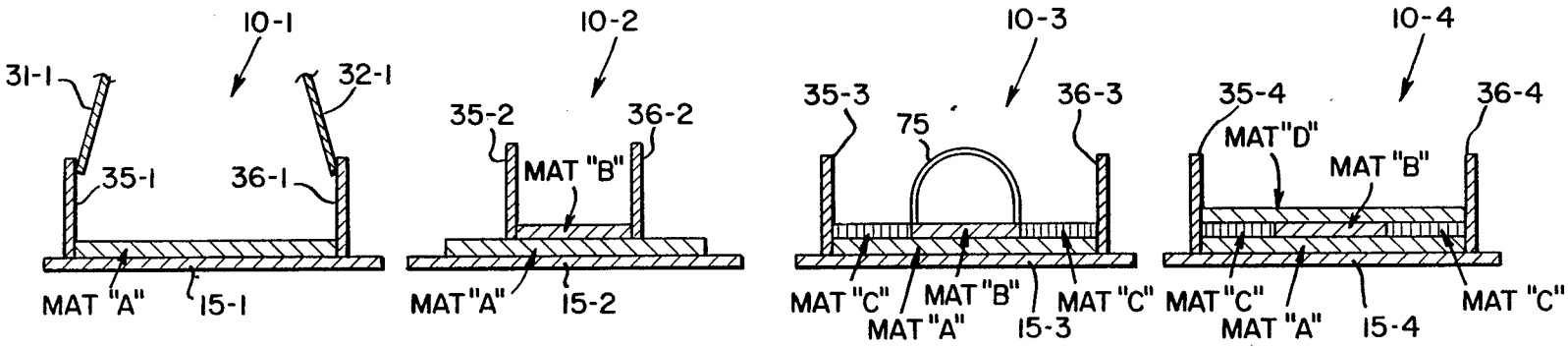
FIG. 5D
FIG. 5C
FIG. 5B
FIG. 5A

METHOD AND APPARATUS FOR FORMING NONWOVEN FIBER WEBS

BACKGROUND OF THE INVENTION

This invention relates to a novel method and apparatus for producing composite nonwoven fiber webs or mats, and more particularly to an improved method and apparatus which permits the inexpensive production of substantially shingle-free nonwoven webs. Still further, this invention relates to a method of employing adjustable, web forming apparatus of the type described to produce composite nonwoven web structures of optionally different shapes and plies.

A major disadvantage of prior, known apparatus for producing nonwoven webs has been the tendency of the apparatus to produce a product which exhibits undesirable shingling. Typically, fibers are deposited at a first location on the operating surface of a rotating condenser or screen conveyor, which travels continuously in one direction. The deposited fibers form on the operating surface a nonwoven web or layer of fibrous material which is continuously doffed or removed from the surface at a second location downstream from the first location. The term "shingling" relates to the tendency of the deposited fibers to become angularly oriented in much the same direction, which causes the web structure to become weak because of less entanglement of its fibers.

As noted in greater detail hereinafter, the present invention permits the nonwoven fibers to form isotropically, or with no particular orientation, thus resulting in substantially greater entanglement of individual fibers in the web structure. The result is a web structure that has the same tear strength characteristics both in the machine direction (MD) of web formation, and in the cross machine direction (XD).

While many such prior apparatus of the type described have been capable of producing nonwoven webs or mats in continuous, multi-ply lengths, and also have been capable of incorporating resins in the webs or mats, such apparatus heretofore have not been capable of forming composite nonwoven structures of optionally different shapes and plies.

Accordingly, it is an object of the invention to provide improved nonwoven web forming apparatus which substantially eliminates any undesirable shingling in the webs or mats produced thereby.

Another object of this invention is to provide improved web forming apparatus of the type described which can be readily adjusted to produce composite nonwoven structures of various configurations, and of various plies within a given structure.

A further object of this invention is to provide a novel method of producing composite nonwoven structures or products of various configurations, and of various thicknesses or plies within a given structure.

Other objects of the invention will be apparent hereinafter from the specification and from the recital of the appended claims, particularly when read in conjunction with the accompanying drawings.

SUMMARY OF THE INVENTION

Airborne fibers, and if desired a powder resin, are blown downwardly through a central opening in a vertically adjustable platform, and into the upper end of a large, adjustable hood mechanism, which is suspended from the underside of the platform. The lower end of the hood mechanism overlies the upper run of an endless, perforated belt or screen, which is mounted to travel unidirectionally in a horizontal plane beneath the hood mechanism. A vacuum supply, which opens on the underside of the screen, causes fibers, and powdered resin if used, to be drawn through the lower end of the hood mechanism, and to be deposited as a nonwoven mat on the upper run of the screen. The mat is thus continuously formed and conveyed by the screen to a discharge point, or optionally, onto the upper run of the next successive screen of an adjacent unit if several such units are connected in series. In the latter case, additional fibers may be added selectively by successive units to the mat formed by the preceding unit or units.

In each unit the hood mechanism comprises a pair of generally rigid curtains or panels which are hingedly connected adjacent their upper edges to the platform adjacent opposite sides of its opening to pivot adjustably about spaced axes extending parallel to the direction of travel of the mat that is formed by the unit. The lower edges of the two curtains overlie the upper run of the screen, and are connected to adjusting devices which can be used to shift the lower edges of the curtains selectively toward and away from each other, thereby to control the width of the mat formed on the screen. Also, a template is removably positioned beneath the upper run of the screen to permit adjustment of the shape of the opening to which the vacuum is applied. Moreover, removable baffles may be positioned on or above a mat to prevent fibers from subsequent units in a series thereof from being deposited on selected areas of said mat.

THE DRAWINGS

Figure 1:
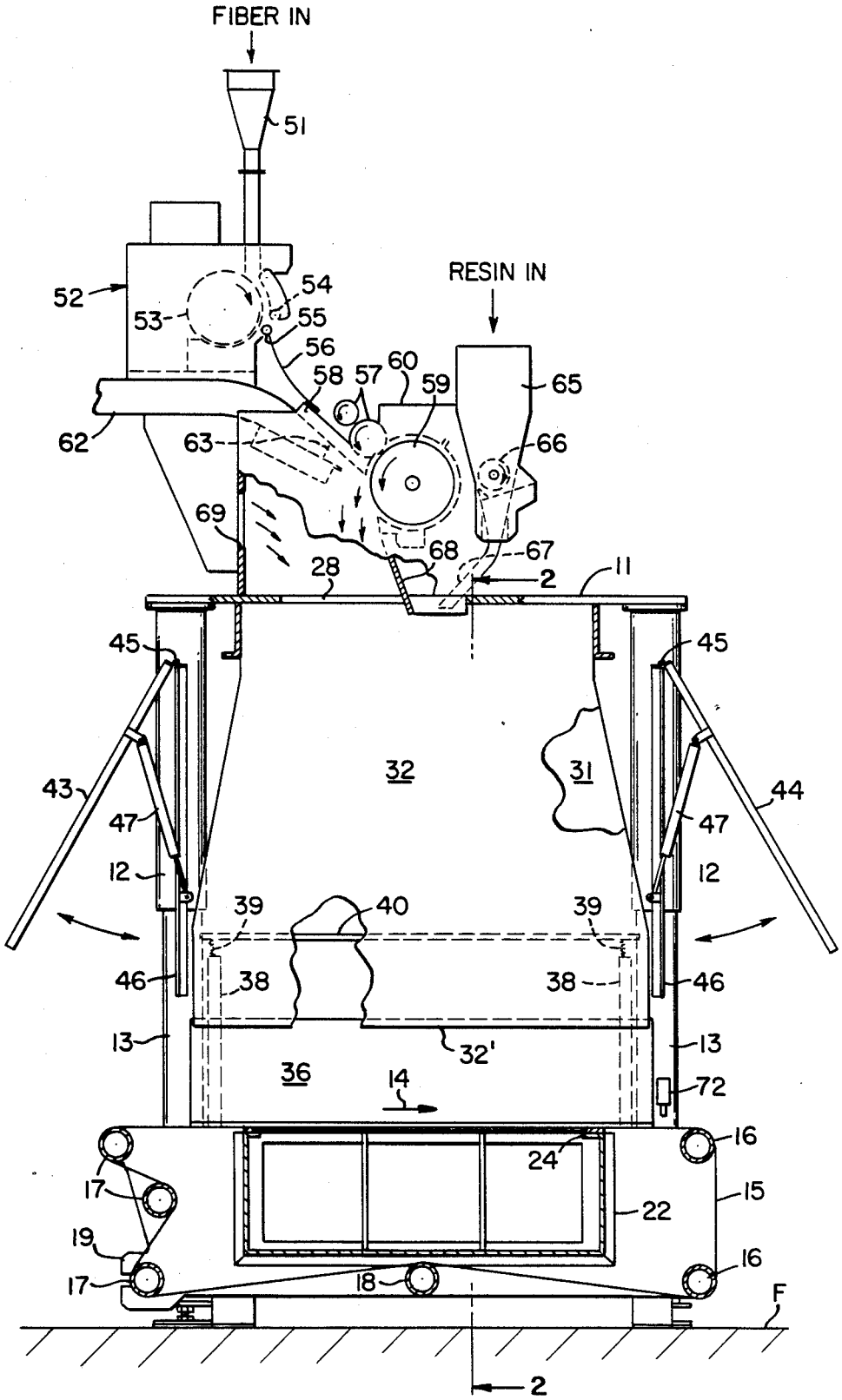
FIG. 1 is a fragmentary sectional view taken approximately through the center of nonwoven web forming apparatus made according to one embodiment of the invention, portions thereof being shown in full.

FIG. 4 is a fragmentary schematic plan view illustrating diagramatically how a plurality (four) of the improved web forming units can be connected in series to form a composite nonwoven fabric; and FIGS. 5A–5D are enlarged fragmentary sectional views taken along the corresponding lines 5A—5A through 5D—5D in FIG. 4 looking in the direction of the arrows and illustrating diagramatically the type of non-woven fabric produced by the series of units shown in FIG. 4.

DETAILED DESCRIPTION OF THE PREFERRED EMBODIMENTS

Referring now to the drawings by numerals of reference, 10 denotes generally a novel web forming device or unit comprising a rectangular, vertically adjustable platform 11 supported adjacent its corners on four, tubular legs 12, the lower ends of which are positioned slidably and adjustably over the upper ends of four, stationary posts 13, which project upwardly from the floor F at rectangularly spaced points thereabout. Mounted to travel horizontally beneath platform 11 in the direction indicated by the arrow 14 in FIG. 1, and between the legs 12 that are located adjacent opposite sides, respectively, of platform 11, is the upper run of an endless, perforated belt or screen 15. Screen 15 is mounted adjacent its forward end to travel around a pair of vertically spaced drums 16, and adjacent its rear end travels around drums 17. Each of these drums, as well as an idler drum 18 which supports the lower run of screen 15, is supported at opposite ends thereof in frame members 19 for rotation about a horizontal axis.

Also mounted beneath the platform 11 between the upper and lower runs of screen 16 is a suction box 22, which is connected by a duct 23 (FIGS. 2 and 3) to the inlet of a suction fan or like source of vacuum (not illustrated). Box 22 has in its upper end an opening 24 that registers with an opening 25 in a template 26 (FIG. 2), which is removably mounted on box 22 beneath the upper run of screen 15. The vacuum generated at registering openings 24, 25 is applied to a central opening 27 in platform 11 via an adjustable hood mechanism 28, which extends downwardly from the underside of platform 11.

Figure 2:
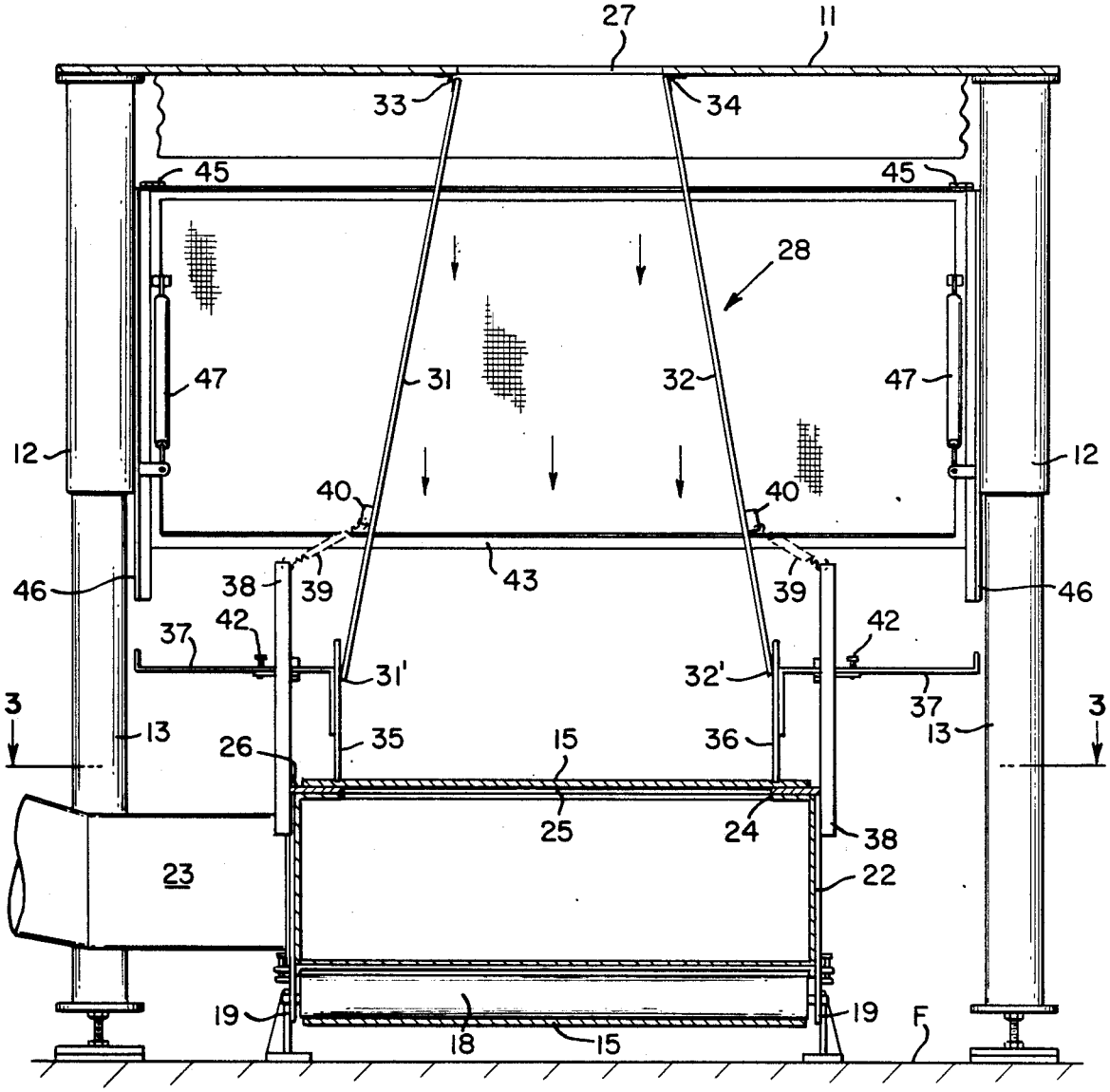
FIG. 2 is an enlarged, fragmentary sectional view of the apparatus taken generally along the line 2—2 in FIG. 1 looking in the direction of the arrows, portions thereof being shown in full.
Figure 3:
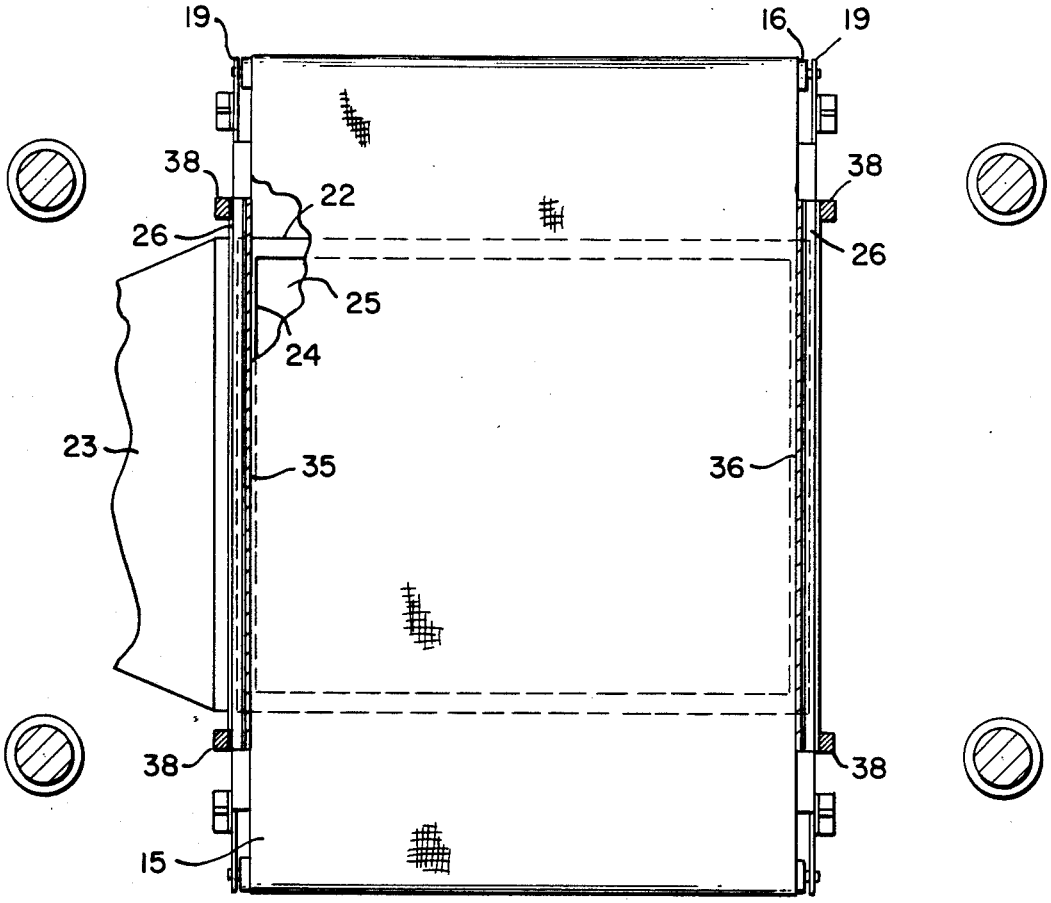
FIG. 3 is an enlarged, fragmentary sectional view taken generally along the line 3—3 in FIG. 2 looking in the direction of the arrows.

Hood mechanism 28 comprises a pair of spaced, rigid, side panels or curtains 31 and 32 that are hinged at their upper edges as at 33 and 34 to platform 11 adjacent opposite sides of opening 27 to pivot about spaced axes that extend parallel to the direction of travel (14) of the upper run of screen 15. As shown in FIGS. 1 and 2, the lower edges 31' and 32' of panels 31 and 32, respectively, are equi-spaced above the upper run of screen 15, and have sliding engagement with the spaced, parallel, inner surfaces of a pair of vertically disposed plates 35 and 36, each of which is carried on the inner ends of a pair of adjusting rods 37, only one each of which is shown in FIG. 2. Each of the rods 37 is mounted intermediate its ends for horizontal sliding adjustment in an opening formed in one of four, like, stationary, vertically disposed bars 38, which are fastened at their lower ends to the frame sides 19 adjacent the posts 13, and which project at their upper ends above the upper edges of plates 35 and 36. Bars 38 are connected at their upper ends by tension springs 39 to opposite ends of a pair of parallel reinforcing bars 40 that are secured to the outer surfaces of panels 31 and 32 to extend parallel to their pivotal axes.

As will be apparent from the drawings, the springs 39 maintain the lower edges 31' and 32' of panels 31 and 32 resiliently engaged with the inside surfaces of plates 35 and 36. These plates can be adjusted toward and away from each other by rods 37, and in turn will cause panels 31 and 32 to be pivoted toward and away from each other, and selectively into different positions about the axes of hinges 33 and 34. The rods 37 can then be secured releasably in their adjusted positions by conventional locking detents 42 (FIG. 2), thus to retain panels 31 and 32 in positions in which they will determine the width of the mat deposited on screen 15. The hood mechanism 28 thus forms an adjustable, generally tunnel shaped passage which extends beneath platform 11 in the direction of travel of the upper run of screen 15, and which is open at opposite ends thereof.

One of the surprising features of this invention is that the hood mechanism 28 does not require at opposite ends thereof impervious panels of the type denoted at 31 and 32. In the embodiment shown, opposite ends of the hood tunnel formed by the mechanism 28 are open to the surrounding atmosphere so that ambient air may be drawn into opposite ends thereof. However, to prevent any accidental injuries, access to opposite ends of the mechanism 28, or the tunnel formed thereby normally is blocked off by a pair of framed, rectangularly shaped screens 43 and 44, the frames of which are hingedly connected at their upper edges as at 45 to elongate support bars 46 which are secured to the inside or confronting surfaces of tubular members 12. Screens 43 and 44 normally are in closed positions (not illustrated) in which they lie in spaced, vertical planes at opposite ends of hood mechanism 28, but can be swung into open positions as shown in FIG. 1 where they will be releasably held by conventional, pneumatic spring cylinders 47 and 48, respectively, (FIG. 1) to permit access to the interior of the hood mechanism.

Referring now to FIG. 1, air-borne fibers may be supplied to the upper end of the hood mechanism 28 by an overhead fiber distribution system similar at least in part to that disclosed in U.S. Pat. No. 4,240,180. Such systems include an overhead supply duct (not illustrated) which may be connected to the upper section 51 of a fiber feed device which is denoted generally at 52 in FIG. 1. Device 52 is supported above the associated platform 11, and includes a conventional, rotating condenser screen or drum 53. The bore in drum 53 is connected in a conventional manner (not illustrated) with a vacuum supply, which causes fibers from the upper section 51 to be formed into a continuous, nonwoven feed mat (not illustrated). This mat is continuously doffed and fed downwardly by associated feed rolls 54 and 55 along a guide plate 56, and onto a lickerin feed plate 58 beneath lickerin feed rolls 57. These feed rolls deliver the mat into the path of the teeth of a rotating lickerin 59, which is mounted to rotate in the housing 60 that is also mounted on plate 11 beneath and adjacent to the feed device 52.

The teeth of the rotating lickerin 59 continuously comb fibers out of the feed mat, and direct them into a stream of air which is fed into the housing 60 through an air inlet duct 62. Duct 62 has an outlet end 63 positioned in housing 60 to direct air beneath the feed plate 58, and into the area where the fibers are combed out of the mat, thereby doffing the fibers from the lickerin 59. The doffed, air-borne fibers pass downwardly out of the lower end of housing 60 in the direction indicated by the the arrows in FIG. 1, and into the upper end of the hood mechanism 28.

Mounted on one side of housing 60 (the right side as shown in FIG. 1) is a resin supply housing 65, which contains adjacent its lower end a rotating feed roll 66, which can be utilized to feed a powdered resin, or the like, into the upper end of the hood mechanism 28 through an outlet duct 67 in the lower end of housing 65.

Mounted in the lower end of housing 60 nearly tangentially of its lickerin is an adjustable partition or wall 68, which separates the lower end of the resin outlet duct 67 from the opening in the lower end of housing 60 through which the fibers are directed into the hood mechanism 28. Partition 68 is adjustable to direct the air and fibers (and resin if present) at various angles into mechanism 28 to produce webs with different characteristics. Remote from the partition 68 the rear or left hand wall of the housing 60 has therein a screened opening 69, which is disposed to permit air from the atmosphere also to enter housing 60.

In practice, the fibers that are doffed from the lickerin 59 are blown downwardly into the upper end of the hood 28 for deposit on the upper run of the screen 15.

Also, if desired, a particular resin binder can be fed from housing 65 into the upper end of the hood 28 simultaneously with the air-borne fibers combed from the mat, or alternatively, the resin can be introduced with the air that is supplied through the inlet duct 62. During this operation the air entering housing 60 will pass through the upper run of screen 15 and into the vacuum box or duct 22, whereby the fibers, or mixture of fibers and resins, is continuously deposited in the form of a shingle-free nonwoven mat on the upper run of the screen 15. The resulting mat or web may be passed beneath a sensing device 72 (FIG. 1) which is supported to extend transversely of the screen 15 forwardly or to the right of the hood mechanism 28. Sensor 72 generates a signal which is proportional to the thickness of the mat or web which is deposited on the screen 15; and this signal in turn is utilized to control the rate of rotation of the feed rolls 57 which supply the mat (not illustrated) to the lickerin 59. Typically, if the mat is too thick the feed rolls slow down to reduce the quantity of fibers which are fed in mat form to the lickerin 59; and, conversely, if the mat sensed by device 72 is too thin, the feed rolls 57 are caused to speed up to increase the amount of fibers fed to the lickerin.

The rate of travel of the screen 15, the rate at which air is drawn into the vacuum box 22, and the rate at which a resin binder can be fed into the hood 28 are variable, as desired. Moreover, the platform 11 is adjustable vertically via the posts 13; and the hood panels 31 and 32 are adjustable to control the width of the mat.

The advantage of the apparatus of the type described above is that it provides a method of making a fiber or fiber/resin mat in a single pass of the screen 15 beneath the lower end of the hood mechanism 28. The isotropic web structures produced by this apparatus can range from, approximately, 0.35 oz/yd$^2$ to 50.0 oz/yd$^2$, and can be easily handled even in their lightest form. Mats of greater weights, or lighter weights made at high speed (e.g. 100 to 300 meters/min.) would require more hoods in line. Moreover, one of the unexpected results of this equipment is that it produces a web structure which has no discernable shingle, even in the case of the heaviest webs produced by this apparatus.

It is possible also that these mats can be made of multiple layers, for example by feeding the mat produced by the first hood 28 successively beneath one or more other hoods associated with like apparatus, so that one layer after another can be laid on the bottommost layer—i.e., the layer produced beneath the first hood 28.

For example, as shown in FIG. 4, wherein the lower halves or mat forming screens 15 of four such units are illustrated in plan at 10-1 through 10-4, the mat or product A (FIG. 5A) formed on screen 15-1 of the first unit 10-1 in the series passes successively beneath the hood mechanisms of units 10-2 through 10-4. The plates 35-2 and 36-2 of the second unit 10-2 are adjusted closer to each other than were the plates 35-1 and 36-1 of the first unit, whereby the mat B (FIG. 5B) formed by the second unit on mat A is narrower than the latter. In the third unit a baffle 75 is removably mounted over mat B so that mats C (FIG. 5C) are formed on mat A at opposite sides of mat B. In the final unit 10-4 a covering mat D (FIG. 5D) is deposited over mats B and C completing a multiply, nonwoven mat which can then be compacted and/or heat treated depending upon the desired nature of the final product.

Also, mat configurations can be easily altered simply by changing the configuration of the opening in the replaceable template 26 which covers the upper end of the suction box 22, thereby causing the formation on the screen 15 of mats having different structures and densities, depending upon the opening in the template 26, and the rate at which the screen 15 moves across the template. Likewise, of course, by varying the overall length of the area which is exposed to the upper end of the suction box 22, the density of the resulting mat can be varied.

While this invention has been illustrated and described in detail in connection with only certain embodiments thereof, it will be apparent that it is capable of still further modification, and that this application is intended to cover any such modifications as may fall within the scope of one skilled in the art or the appended claims.

We claim:

1. Apparatus for producing nonwoven fiber mats comprising;

a frame, a screen mounted on said frame to travel in an endless path, and having an upper run mounted to travel in a generally horizontal plane in one direction, a platform mounted on said frame above and in vertically spaced relation to the upper run of said screen, means for directing a supply of fibers downwardly through an opening in said platform and onto said upper run of said screen to form a substantially shingle-free nonwoven fiber mat thereon, said means comprising an adjustable hood mechanism extending between said platform and said upper run of said screen, and operative to guide fibers from said supply thereof onto preselected surface areas of said upper run, said hood mechanism comprising a pair of adjustable, laterally spaced, fiber-guiding curtain members connected adjacent their upper ends to said platform adjacent opposite sides, respectively, of said opening therein, and extending downwardly therefrom to points adjacent opposite sides, respectively, of said upper run of said screen, said pair of curtain members being operative to form therebetween a generally tunnel shaped passage extending beneath said platform in the direction of travel of said upper run, and open at opposite ends thereof to the ambient atmosphere, means adjacent opposite sides of said upper run of said screen for moving the lower ends of said curtain members selectively toward and away from each other, thereby selectively to decrease or increase, respectively, the space between said curtain members and consequently the width of the mat formed on said screen.

2. Apparatus as defined in claim 1, including a vacuum chamber having therein a suction opening positioned beneath and in registry with the upper run of said screen thereby to draw fibers from said hood mechanism onto said upper run to form a nonwoven mat thereon, and a template removably mounted on said chamber over said suction opening and beneath said upper run of said screen, and having therethrough an opening disposed to register with at least a portion of said suction opening, and operative to determine the configuration of the mat deposited on said upper run.

3. Apparatus as defined in claim 1, including means adjustably mounting said platform on said frame for limited vertical adjustment relative to said upper run of said screen.

4. Apparatus as defined in claim 1, including a vacuum chamber positioned beneath said upper run and having a suction opening registering with the underside of said upper run and the space between said curtain members, whereby ambient air is caused to enter the space between said curtain members through the open ends of the tunnel shaped passage formed therebetween and to be drawn into said vacuum chamber through the suction opening therein.

5. Apparatus as defined in claim 4, including a pair of safety screens mounted on said hood mechanism for movement selectively between open positions to permit ready access through opposite ends of said tunnel shaped passage to the space between said curtain members, and closed positions over opposite ends of said passage to limit access to said space.

6. Apparatus as defined in claim 1, wherein said curtain members comprise a pair of spaced panels hingedly connected adjacent their upper edges to the underside of said platform for pivotal adjustment about spaced, parallel axes extending in said one direction, said means for moving said lower ends of said curtain members comprise a pair of operating rods slidably mounted in said frame adjacent opposite sides of said upper run of said screen for movement selectively toward and away from each other, and means connecting said rods to said panels and operative to effect pivotal adjustment of said panels in response to the slidable adjustment of said operating rods.

7. Apparatus for producing substantially shingle-free nonwoven fiber mats, comprising a frame, a screen mounted on said frame to travel in an endless path, and having an upper run mounted to travel in a generally horizontal plane in one direction, means on said frame for directing a supply of fibers randomly downwardly through a fiber supply opening spaced vertically above said upper run of said screen, a vacuum chamber having therein a suction opening positioned beneath and in registry with the upper run of said screen thereby to draw fibers from said fiber supply opening onto said upper run of said screen in the form of a nonwoven fiber mat, and means for selectively changing the configuration of said suction opening, thereby to effect a corresponding change in the configuration of the mat formed on said upper run of said screen, said means for changing the configuration of said suction opening comprising a template removably mounted on said chamber over said suction opening and beneath said upper run of said screen, and having therethrough an opening disposed to register with at least a portion of said suction opening.

8. Apparatus as defined in claim 7, wherein said means for changing the configuration of said suction opening comprises a baffle removably positioned over said upper run of said screen to overlie a predetermined portion of said suction opening and the registering portion of said upper run passing thereover, whereby said baffle prevents the deposit of fibers on said registering portion of said upper run.

9. Apparatus as defined in claim 1, wherein said means for directing a supply of fibers further comprises a toothed, rotary lickerin mounted on said platform above said opening therein, and means on said platform for feeding a fiber feed mat into the path of the teeth projecting from the surface of said rotary lickerin, whereby fibers are combed by the lickerin from said feed mat and are discharged downwardly through said opening in said platform and into the upper end of said hood mechanism.

10. Apparatus as defined in claim 9, including means on said platform and operable selectively to direct powdered resin downwardly through said opening in said platform simultaneously with the fibers discharged into the hood mechanism by said lickerin.

11. A method of producing a substantially shingle-free nonwoven fiber mat, comprising forming a generally tunnel shaped passage open at opposite ends thereof and having laterally spaced side walls, providing a screen mounted to travel in an endless path, and with at least one run thereof disposed to travel generally horizontally in one direction beneath said tunnel shaped passage to form the bottom thereof, and over a suction opening which lies in a plane beneath and parallel to said one run of said screen, connecting said suction opening to a source of vacuum that causes air to be sucked into opposite ends of said passage and through said one run of the screen as its passes over said suction opening, causing a supply of fibers to be dropped continuously and randomly downwardly through an opening in the top of said tunnel shaped passage and onto said one run of said screen from a fiber supply spaced vertically above and in registry with said suction opening, thereby continuously to produce on said one run a shingle-free nonwoven mat that is conveyed by said screen in said one direction, utilizing said side walls of said passage for positively guiding fibers downwardly only along opposite sides of said tunnel shaped passage, and continuously from adjacent opposite sides of said opening in the top of said passage to adjacent opposite sides, respectively, of said upper run of said screen, thereby positively to control the width of the nonwoven mat produced on said upper run, and relying solely upon the air, which is drawn into said opposite ends of said passage by vacuum at said suction opening, to cause fibers from said fiber supply to be drawn toward and retained within opposite ends, respectively, of said tunnel shaped passage.

12. A method as defined in claim 11, including selectively changing the configuration of said suction opening, thereby to cause a corresponding change in the configuration of said nonwoven mat.

13. A method as defined in claim 11, including providing a plurality of said screens connected in series, so that the mat produced on the upper run of the first of the screens in said series will be conveyed successively over the upper runs of the remainder of the screens in said series, continuously feeding fibers randomly onto the upper runs of said screens in said series thereof, and causing the suction openings registering with successive upper runs of said screens to differ in configuration from the suction opening that registers with the upper run of the preceding screen, whereby the composition of said mat will be altered upon passage over each succeeding screen.

* * * * *